US010299358B2

(12) United States Patent
Saccoccio et al.

(10) Patent No.: US 10,299,358 B2
(45) Date of Patent: May 21, 2019

(54) LIGHT CONTROLLED TIMING DEVICE AND METHOD

(71) Applicant: Asia Connection LLC., New York, NY (US)

(72) Inventors: Mitch Saccoccio, Clarksville, VA (US); Jonathan Bonelli, New York, NY (US)

(73) Assignee: Asia Connection LLC, New York, NY (US)

( * ) Notice: Subject to any disclaimer, the term of this patent is extended or adjusted under 35 U.S.C. 154(b) by 720 days.

(21) Appl. No.: 14/267,291

(22) Filed: May 1, 2014

(65) Prior Publication Data

US 2014/0327326 A1 Nov. 6, 2014

Related U.S. Application Data

(60) Provisional application No. 61/819,062, filed on May 3, 2013.

(51) Int. Cl.

*H05B 37/00* (2006.01)
*H05B 37/02* (2006.01)
*H05B 33/08* (2006.01)

(52) U.S. Cl.

CPC ..... *H05B 37/029* (2013.01); *H05B 33/0842* (2013.01); *Y10T 307/773* (2015.04)

(58) Field of Classification Search

CPC ..... H01H 37/00; H05B 37/00; H05B 33/00; Y02B 20/00
USPC ..... 307/117
See application file for complete search history.

(56) References Cited

U.S. PATENT DOCUMENTS

| | | | | |
|---|---|---|---|---|
| 4,191,328 | A * | 3/1980 | Isaacs | G05D 23/1904 165/238 |
| 5,768,020 | A * | 6/1998 | Nagao | B60R 1/088 359/604 |
| 5,808,294 | A * | 9/1998 | Neumann | G05B 19/0426 250/214 AL |
| 9,049,755 | B2 * | 6/2015 | Ku | H05B 37/0245 |
| 2006/0146652 | A1 * | 7/2006 | Huizi | G04G 9/0076 368/107 |
| 2007/0029949 | A1 * | 2/2007 | Null | H05B 37/0218 315/308 |
| 2011/0132086 | A1 * | 6/2011 | Wang | G01D 11/245 73/431 |

* cited by examiner

*Primary Examiner* — Rexford N Barnie
*Assistant Examiner* — Joseph N Inge
(74) *Attorney, Agent, or Firm* — Dilworth & Barrese, LLP

(57) ABSTRACT

A dual mode light operated timing device includes a light sensor for generating a light sensor signal when light is detected; a first input device for generating a first programming signal; a second input device for generating a second programming signal; a switch for connecting and disconnecting power from a power supply to an electronic device; and a processor for receiving the light sensor signal and when light is detected by the light sensor operating the timing device in a daytime mode by controlling the switch based on the first programming signal, and when light is not detected by the light sensor operating the timing device in a nighttime mode by controlling the switch based on the second programming signal.

18 Claims, 4 Drawing Sheets

LIGHT CONTROLLED TIMING DEVICE AND METHOD

REFERENCE TO PRIOR APPLICATIONS

This application claims the benefit of U.S. Provisional Application No. 61/819,062, filed May 3, 2013, the contents of which are incorporated herein by reference in its entirety.

BACKGROUND

Automatic control of electric devices has developed throughout the electrical age. Lighting, air conditioning, and filtration systems, to name a few, often require the switching on and off of electric power to properly and economically operate the electric device.

Leaving a light on all day so that at dusk and into darkness the light will be available is a poor use of electricity and would increase costs of supplying light at night. Running an air conditioning system at identical modes during the heat of the day and the cooler night increases cooling costs above and beyond what is necessary for a comfortable indoor environment. Operating modes of a pool filter system during the daylight hours when use is high and the heat of the sun is greatest are different from the operating modes required during the night hours when use is low and the sun is not actively affecting the chemical balance of the pool water.

Various systems have been available to control these electric devices. Among these control devices are mechanical timers and light sensors.

Mechanical timers were introduced having analog clock-like mechanisms and mechanical pegs or slides to physically and mechanically throw a switch between its on and off positions. The mechanical clock mechanisms often wear out and fault. The on/off switch mechanisms, whether in the pegs or sliders or switch itself, often fail after a short period of time.

Light sensors are typically utilized in systems to turn on a light. Light sensor systems determine when the amount of ambient light falls below a threshold level. When this absence of light is determined, the system will trigger a switch to supply power to the light.

This disclosure describes improvements over these prior art technologies.

SUMMARY

Accordingly, a dual mode light operated timing device is provided. The timing device includes a light sensor for generating a light sensor signal when light is detected; a first input device for generating a first programming signal; a second input device for generating a second programming signal; a switch for connecting and disconnecting power from a power supply to an electronic device; and a processor for receiving the light sensor signal and when light is detected by the light sensor operating the timing device in a daytime mode by controlling the switch based on the first programming signal, and when light is not detected by the light sensor operating the timing device in a nighttime mode by controlling the switch based on the second programming signal.

Accordingly, a method for controlling power to an electric device is provided. The method includes receiving at a processor a light sensor signal when light is detected by a light sensor; receiving at the processor from a first input device a first programming signal, receiving at the processor from a second input device a second programming signal; and connecting and disconnecting power from a power supply to an electronic device, wherein when light is detected by the light sensor the processor is programmed to operate the timing device in a daytime mode by controlling the switch based on the first programming signal, and when light is not detected by the light sensor the processor is programmed to operate the timing device in a nighttime mode by controlling the switch based on the second programming signal.

BRIEF DESCRIPTION OF THE DRAWINGS

The present disclosure will become more readily apparent from he specific description accompanied by the following drawings, in which.

Like reference numerals indicate similar parts throughout the figures.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Reference will now be made in detail the exemplary embodiments of the present disclosure, which are illustrated in the accompanying figures.

Figure 1:
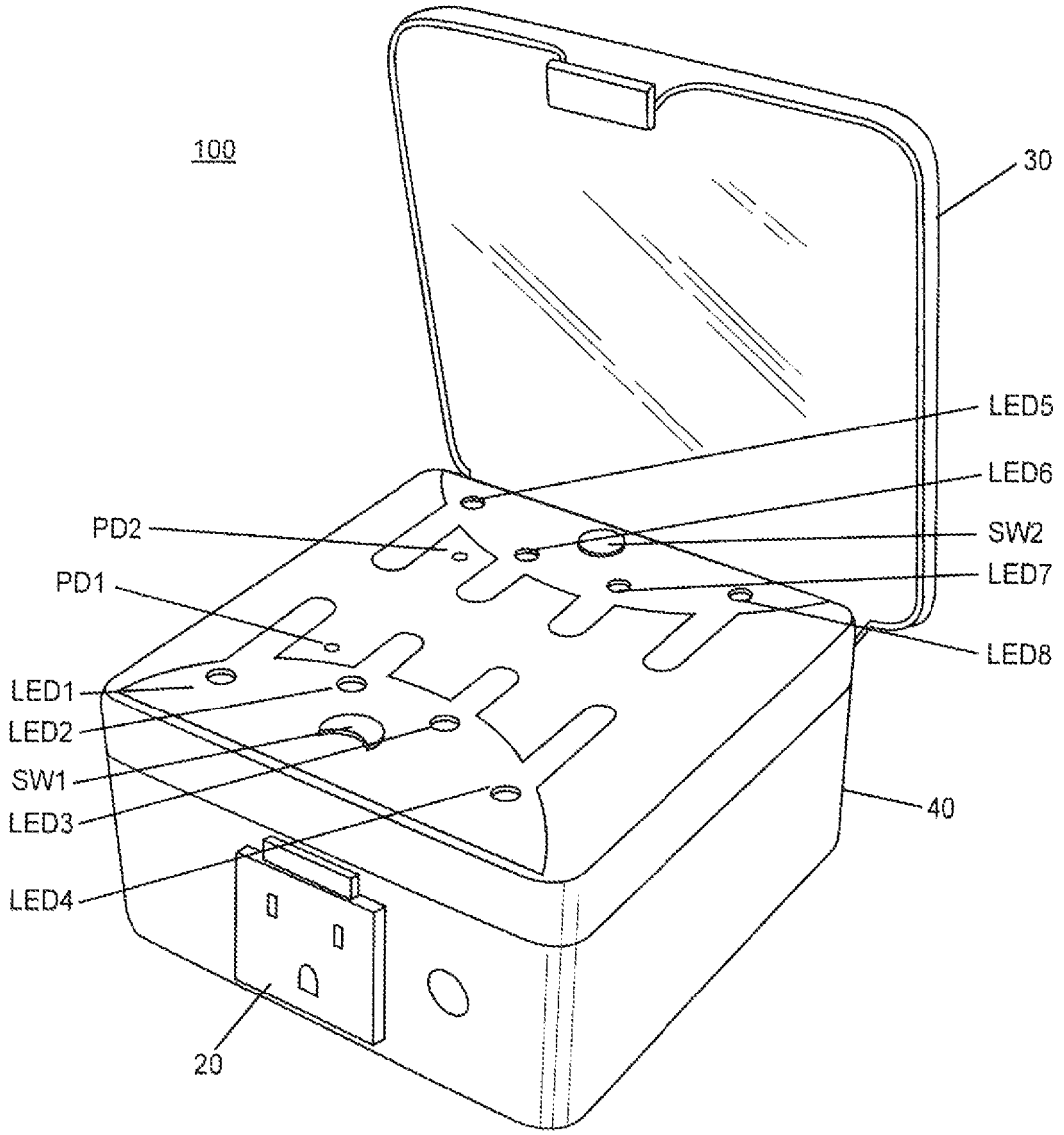
FIG. 1 is diagram illustrating a timing device according the present disclosure.

FIG. 1 is a diagram of a light controlled timing device according to the present disclosure. Shown in FIG. 1 is timing device 100. Timing device 100 includes photo diodes PD1 and PD2, light emitting diodes (LEDs) LED1-LED8, receptacle 20, cover 30 and casing 40. Power is supplied to the timing device from a power source through a power cord or hard-wired electrical connection (not shown in FIG. 1 and partially shown in FIG. 4).

As will be more apparent later, cover 30 is transparent or translucent to light to permit photo diodes PD1/PD2 to detect the ambient light even when cover 30 is closed. Further, cover 30 can be self closing to allow for weather resistant operation in outdoor environments. In addition casing 40 and the other components can also be of weather resistant material to permit weather resistant operation in outdoor environments. Other weather resisting components are contemplated, e.g. a seal on cover 30 to seal against casing 40.

Figure 2:
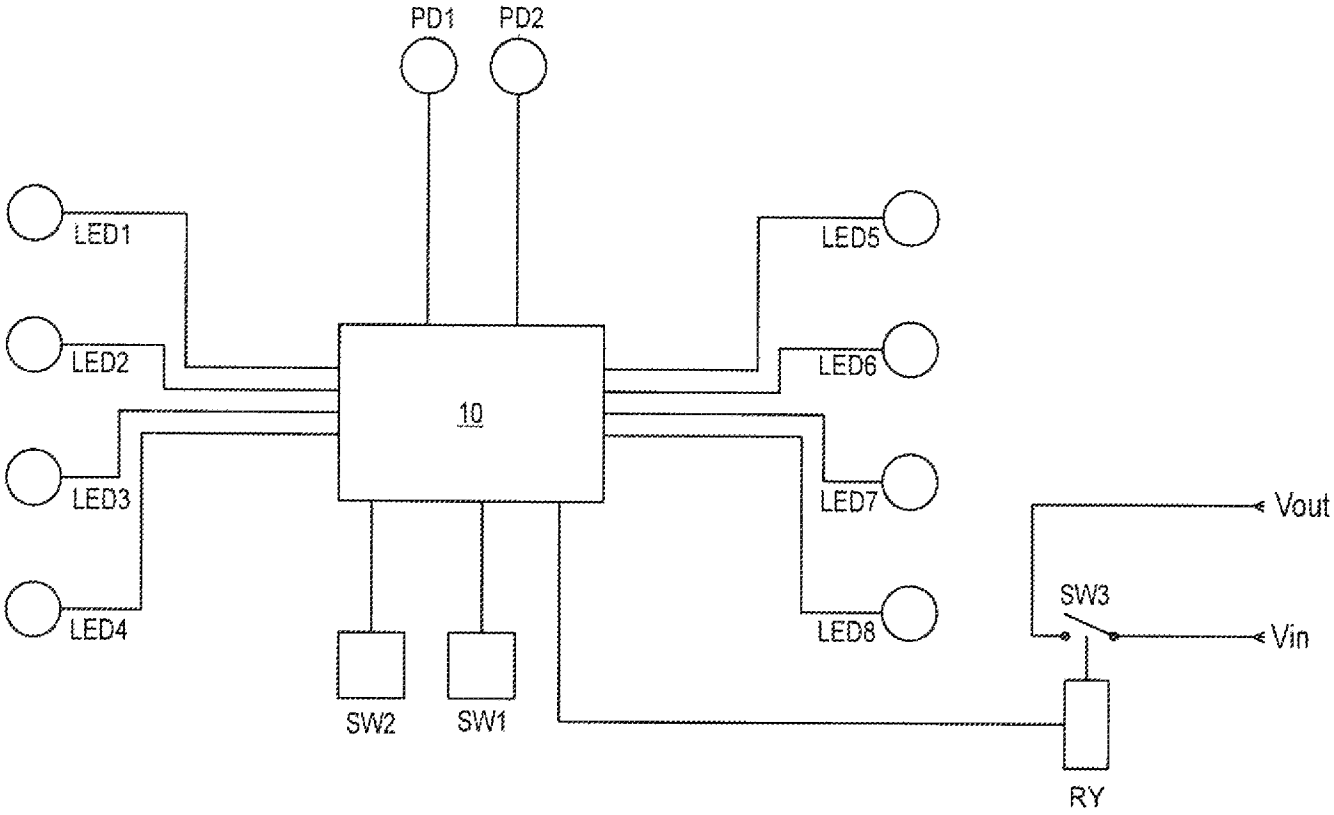
FIG. 2 is a block diagram of the timing device control circuitry according to the present disclosure.

FIG. 2 is a block diagram of the control circuit of timing device 100. LEDs LED1-LED8, photo diodes PD1-PD2 and switches SW1-SW2 are shown. Also shown are processor 10, relay RY, and switch SW3. Switch SW3 connects/disconnects Vin and Vout based on the state of relay RY. In the present disclosure Vin and Vout can be high current and high voltage such as 120 or 240 volts at 10, 15 or 20 amps. Other voltage/ampere levels are contemplated. Processor 10 is a specialty processor and is specifically programmed with a non-transitory program to operate the timing device 100 as described herein.

Figure 3:
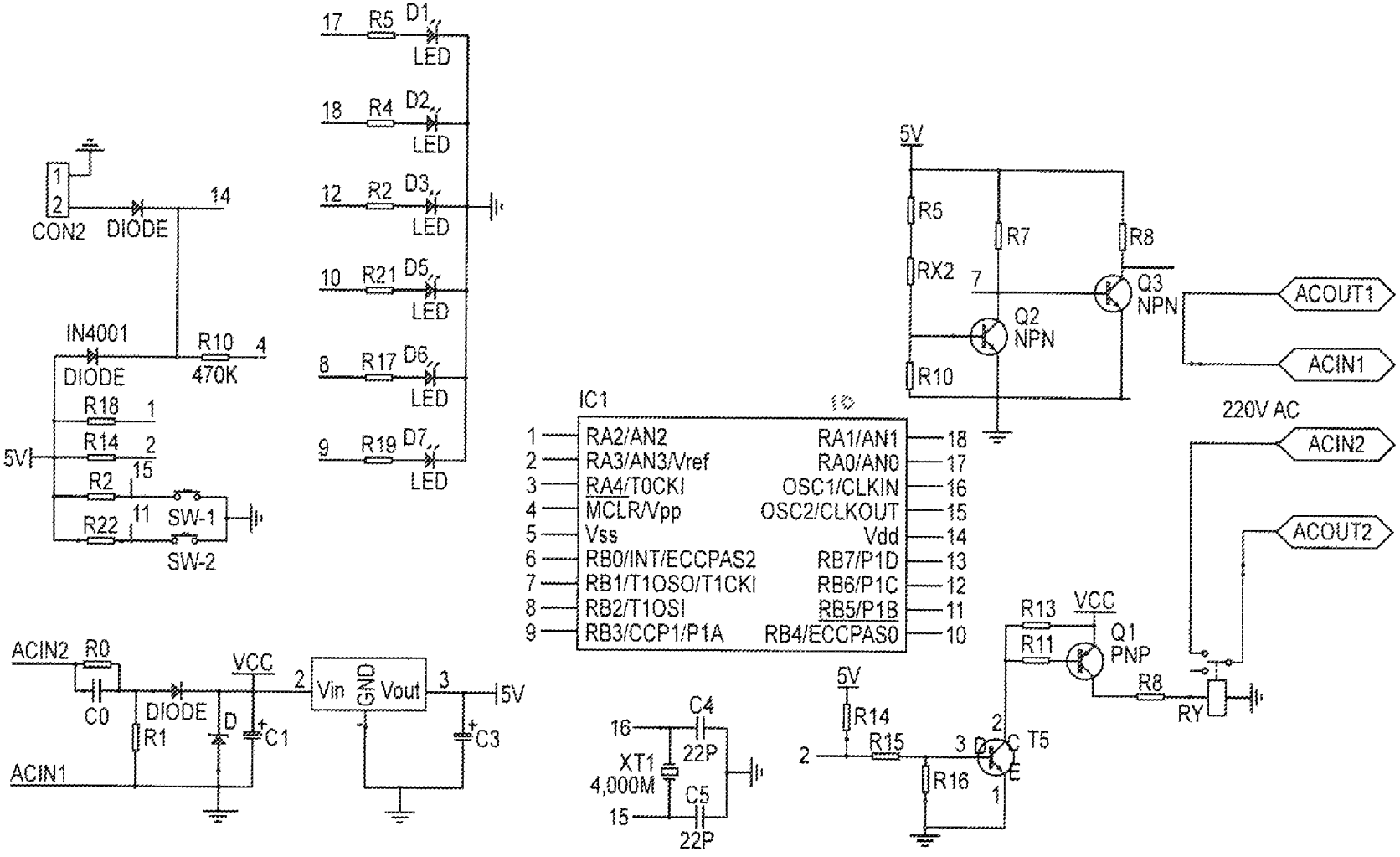
FIG. 3 is a schematic diagram of the timing device according to the present disclosure.

FIG. 3 is a schematic diagram of the control circuit of timing device 100. It is noted that although 2 photo diodes are shown in FIGS. 2 and 3, one photo diode can be used in the operation of the timing device through simple circuit design and processor programming. Processor 10 is illustrated as specialty processor IC1.

In operation, timing device 100 has 2 main modes of operation: daytime mode and nighttime mode. Processor 10 of timing device 100 determines which mode to operate in based on the signals received from photo diodes PD1/PD2. If photo diode PD1 senses light, processor 10 operates timing device 100 in daytime mode. If photo diode PD2 does not sense light, processor 10 operates timing device 100 in nighttime mode. As described above, 1 photo diode can be used in stead of 2. When controlling a pool filter, the dual modes permit the filter to operate for a preset number of hours during the day, but allows for a different preset operation during the night, which allows for a more optimal operation.

Dual mode light operated timing device 100 is initially connected to a power supply. After connection to the power supply, timing device 100 is ready for programming. It is understood that a default mode can be set to control timing device 100 without the need for further programming. The default mode can be selected from any of the following mode descriptions, or from others that fall within the scope and spirit of the present disclosure.

Switches SW1/SW2 are used to program timing device 100. Switches SW1/SW2 are described herein as push button switches, but other input devices are contemplated. In the present disclosure, switch SW1 is used to program the daytime mode and switch SW2 is used to program the nighttime mode.

By pressing switch SW1 processor cycles through the preset timing durations to connect power to Vout for daytime mode. For example, pressing SW1 once, twice, thrice or four times can cycle timing duration through 2 hours, 4 hours, 6 hours and always on, respectively, during the daytime mode. Other timing duration schemes are contemplated. One or more LEDs from LED1-LED4 would also light up to indicate the timing duration selected.

By pressing switch SW2 processor cycles through the preset timing durations to connect power to Vout for nighttime mode. For example, pressing SW2 once, twice, thrice or four times can cycle timing duration through 2 hours, 4 hours, 6 hours and always on, respectively, during the nighttime mode. Other timing duration schemes are contemplated. One or more LEDs from LED5-LED8 would also light up to indicate the timing duration selected.

Based on the selected or default programming, processor 10 will energize or de-energize relay RY to connect or disconnect power between Vin and Vout to supply power to the connected electrical device, e.g. the pool filter, for the programmed timing durations.

For example, once light is detected, timing device 100 enters daytime mode. If 6 hours was selected, processor 10 will energize relay RY for 6 hours to close switch SW3 and connect power from Vin to Vout. Processor 10 can set a countdown timer to track the time the elapses between the energizing of relay RY and 6 hours later (in this example). After 6 hours has passed, processor 10 will de-energize relay RY and disconnect power between Vin and Vout. For the remainder of the daylight hours, no power will be supplied to Vout, thus maintaining the connected electrical device in an off state.

Once light is no longer detected, timing device 100 enters nighttime mode. If 4 hours was selected, processor 10 will energize relay RY for 4 hours to close switch SW3 and connect power from Vin to Vout. Processor 10 can set a countdown timer to track the time the elapses between the energizing of relay RY and 4 hours later (in this example). After 4 hours has passed, processor 10 will de-energize relay RY and disconnect power between Vin and Vout. For the remainder of the night hours, no power will be supplied to Vout, thus maintaining the connected electrical device in an off state.

Timing device 100 can operate an electrical device for preset timing durations during both a daytime mode and a nighttime mode a more effective and economical operation. In addition, timing device 100 does not suffer the problems of existing mechanical timers.

Figure 4:
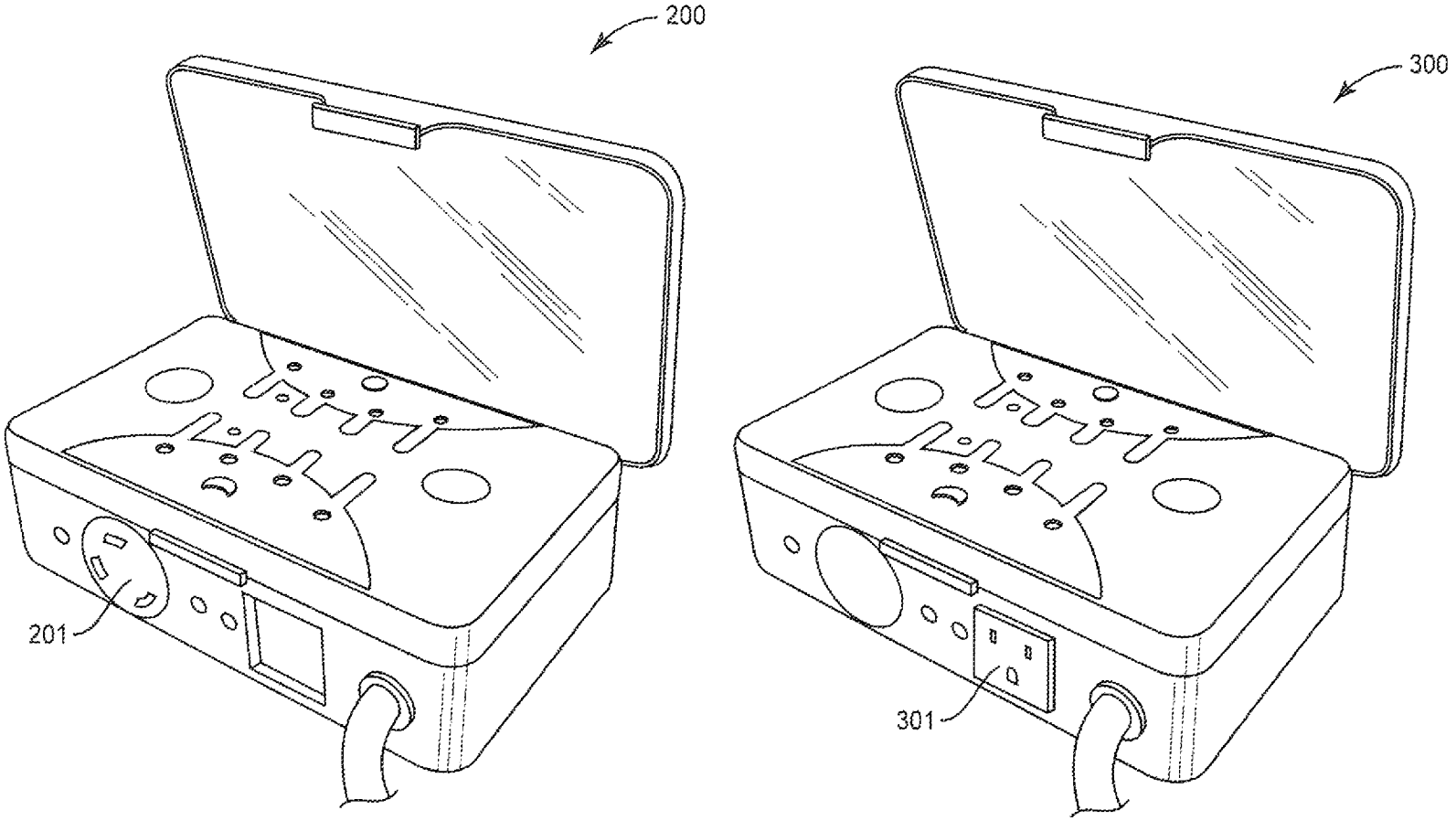
FIG. 4 is a diagram illustrating other timing devices according to the present disclosure.

FIG. 4 is a diagram of alternate embodiments of a timing device according to the present disclosure. Timing devices 200 and 300 are larger versions designed to accommodate components for higher amperages. Timing device 200 is shown having a twist lock receptacle. Other features and operations are similar to those described above.

The present disclosure has been described herein in connection with a pool filtration system. Other applications are contemplated.

Where this application has listed the steps of a method or procedure in a specific order, it may be possible, or even expedient in certain circumstances, to change the order in which some steps are performed, and it is intended that the particular steps of the method or procedure claim set forth herebelow not be construed as being order-specific unless such order specificity is expressly stated in the claim.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A dual mode light operated timing device, comprising:

a light sensor for generating a light sensor signal when light is detected;

a first input device for generating a first programming signal, the first input device configured to select from a plurality of preset daytime mode durations, whereby activating the first input device cycles through the preset daytime mode durations;

a second input device for generating a second programming signal, the second input device configured to select from a plurality of preset nighttime durations, whereby activating the second input device cycles through the preset nighttime mode durations;

a switch for connecting and disconnecting electric power from a power supply to an electronic pool filter device; and a processor for receiving the light sensor signal and when light is detected by the light sensor operating the dual mode light operated timing device in a daytime mode by controlling the switch based on the first programming signal, and when light is not detected by the light sensor, operating the dual mode light operated timing device in a nighttime mode by controlling the switch based on the second programming signal, wherein the first programming signal configures the processor to supply power to the electronic pool filter device for the selected preset daytime mode duration and the second programming signal configures the processor to supply power to the electronic pool filter device for the selected preset nighttime mode duration.

2. The dual mode light operated timing device of claim 1, wherein the light sensor is a photo diode.

3. The dual mode light operated timing device of claim 1, wherein the first input device is a push button switch, there are four daytime mode durations and each time the push button of the first input device is activated, the first input device sequentially selects a new daytime mode duration.

4. The dual mode light operated timing device of claim 1, wherein the second input device is a push button switch, there are four nighttime mode durations and each time the push button of the second input device is activated, the second input device sequentially selects a new nighttime mode duration.

5. The dual mode light operated timing device of claim 1, wherein the switch is a relay.

6. The dual mode light operated timing device of claim 1, further comprising a second light sensor, wherein the light sensor controls the daytime mode and the second light sensor controls the nighttime mode.

7. The dual mode light operated timing device of claim 1, wherein the first and second programming signals program the processor to set a duration power is connected to the electric device and those durations are two hours, four hours, six hours and always on.

8. The dual mode light operated timing device of claim 7, further comprising at least one indicator for indicating the duration power is to be supplied for both the daytime and nighttime modes.

9. The dual mode light operated timing device of claim 1, wherein the dual mode light operated timing device is enclosed in a water resistant container and electrically connected to operate the electronic pool filter device.

10. The dual mode light operated timing device of claim 9, wherein the water resistant container includes a translucent cover to permit light to pass therethrough and operate the light sensor.

11. A method for controlling power to an electronic device, comprising the steps of:

selecting one of a plurality of preset daytime mode durations by activating a first input device;

selecting one of a plurality of preset nighttime mode durations by activating a second input device;

receiving at a processor a light sensor signal when light is detected by a light sensor;

receiving at the processor from the first input device a first programming signal corresponding to the selected daytime mode duration;

receiving at the processor from the second input device a second programming signal corresponding to the selected nighttime duration; and connecting power from a power supply to an electronic pool filter device, wherein when light is detected by the light sensor the processor is programmed to operate a timing device for the selected daytime mode duration by controlling the switch based on the first programming signal, and when light is not detected by the light sensor the processor is programmed to operate the timing device for the selected nighttime mode duration by controlling the switch based on the second programming signal, wherein power is supplied to the electronic pool filter device for a first duration during the daytime mode duration and power is supplied to the electronic pool filter device for a second duration during the nighttime mode duration.

12. The method for controlling power to an electronic device of claim 11, wherein the first and second programming signals program the processor to set a duration power is connected to the electronic device in the daytime and nighttime modes.

13. The method for controlling power to an electronic device of claim 12, further comprising indicating via at least one indicator the duration power is to be supplied during the daytime mode and during the nighttime mode.

14. The method for controlling power to an electronic device of claim 11, further comprising disconnecting power to the electric pool filter device after a set duration of time during both the daytime and nighttime modes.

15. The dual mode light operated timing device of claim 1, wherein the first programming signal and the second programming signal each also indicate a duration of time that power is supplied so that the electronic pool filter device remains in operation according to the durations of time indicated.

16. The method for controlling power to an electronic device of claim 12, further comprising disconnecting power to the electric pool filter device after a set duration of time during both the daytime and nighttime modes.

17. The method for controlling power to an electronic device of claim 11, wherein the daytime mode duration is selected by repeatedly pressing a first button to cycle through the preset daytime mode durations and the nighttime mode duration is selected by repeatedly pressing a second button to cycle through the preset nighttime mode durations.

18. The dual mode light operated timing device of claim 1, wherein the first and the second input device is a push button, an indicator light is associated with each of the preset daytime mode and nighttime mode durations and activating the push buttons activates the indicator light to indicate the duration selected.

* * * * *